United States Patent [19]

Sullivan et al.

[11] 4,001,575

[45] Jan. 4, 1977

[54] LUMINAIRE AND LUMINAIRE ARRANGEMENT FOR LIGHTING THE CEILING WITHIN A ROOM

[75] Inventors: Daryl Dean Sullivan; Herbert Arnold Odle, both of Newark, Ohio

[73] Assignee: Johns-Manville Corporation, Denver, Colo.

[22] Filed: May 27, 1975

[21] Appl. No.: 581,329

[52] U.S. Cl. ..... 240/81 LD; 240/106 R

[51] Int. Cl.[2] ..... F21V 7/09; F21V 21/06

[58] Field of Search ..... 240/25, 106, 103 R, 240/41.1, 81 R, 93, 81 LD, 73 R, 73 LD, 78 R, 78 LD

[56] References Cited

UNITED STATES PATENTS

| | | | |
|---|---|---|---|
| 993,877 | 5/1911 | Ritter | 240/103 R X |
| 2,125,319 | 8/1938 | Schlumbohm | 240/81 LD X |
| 2,201,094 | 2/1939 | Kassel | 240/78 LD X |
| 2,297,124 | 9/1942 | Anderson et al. | 240/93 X |
| 2,305,723 | 12/1942 | Livers | 240/81 LD |
| 3,170,634 | 2/1965 | Harling | 240/81 R X |

FOREIGN PATENTS OR APPLICATIONS

| | | | |
|---|---|---|---|
| 718,393 | 3/1942 | Germany | 240/78 LD |
| 521,329 | 5/1940 | United Kingdom | 240/78 LD |

*Primary Examiner*—Joseph F. Peters, Jr.
*Attorney, Agent, or Firm*—Robert M. Krone; Joseph J. Kelly; Stephen C. Shear

[57] ABSTRACT

An arrangement for indirectly lighting a room by directly lighting the ceiling within the room is disclosed herein and includes a plurality of luminaires spaced from one another within the room. Each luminaire is spaced below the ceiling, preferably supported on the floor of the room in a readily mobile fashion, and directs light onto the ceiling both directly above it in the direction of zenith and at wide angles with zenith.

16 Claims, 5 Drawing Figures

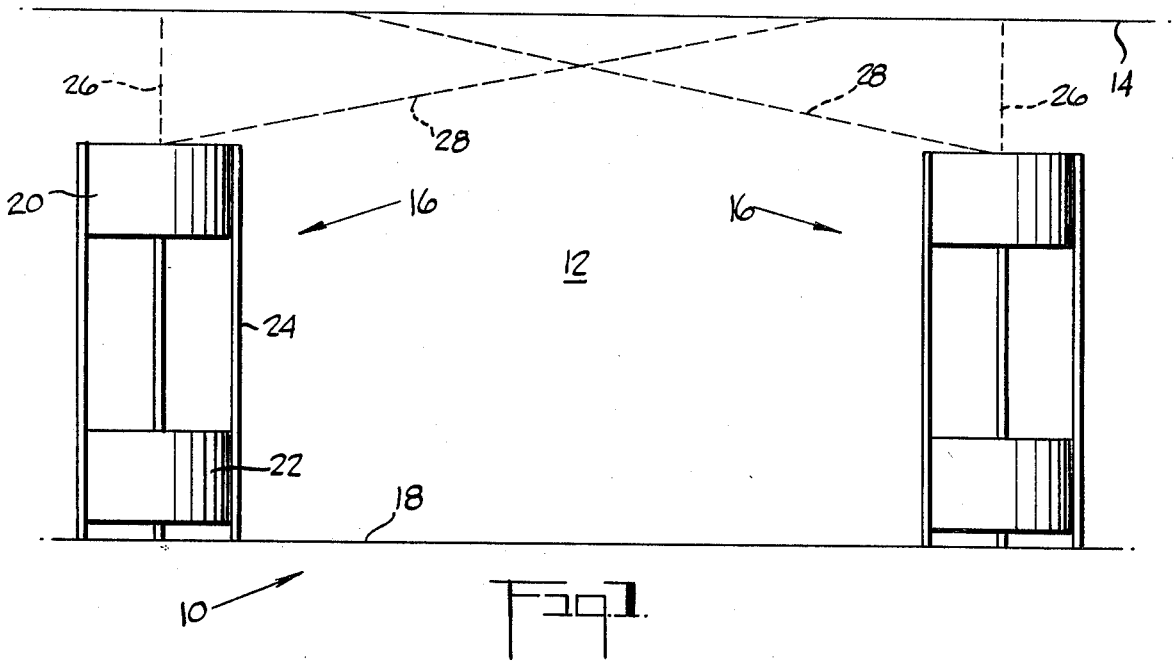
Fig. 1.
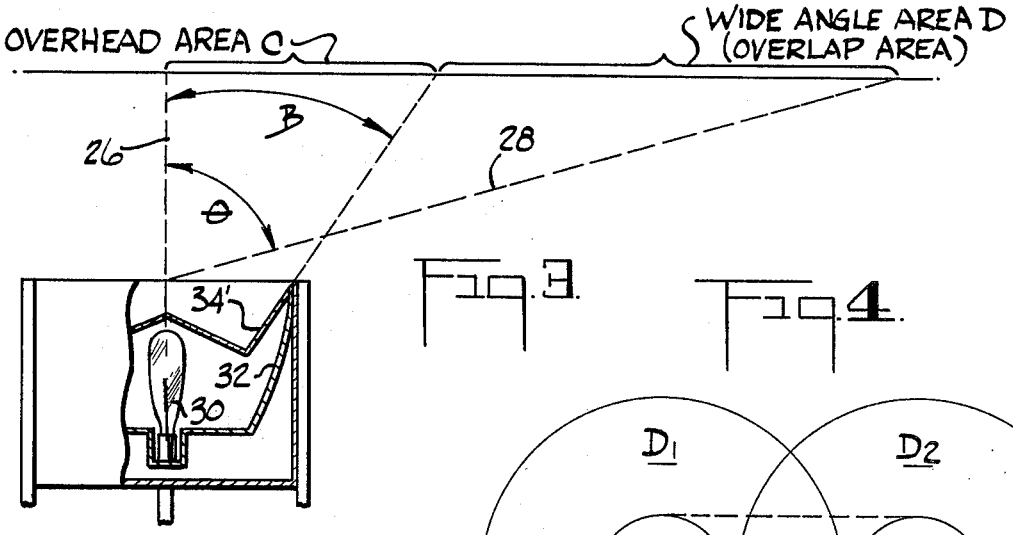
Fig. 3.
Fig. 4.
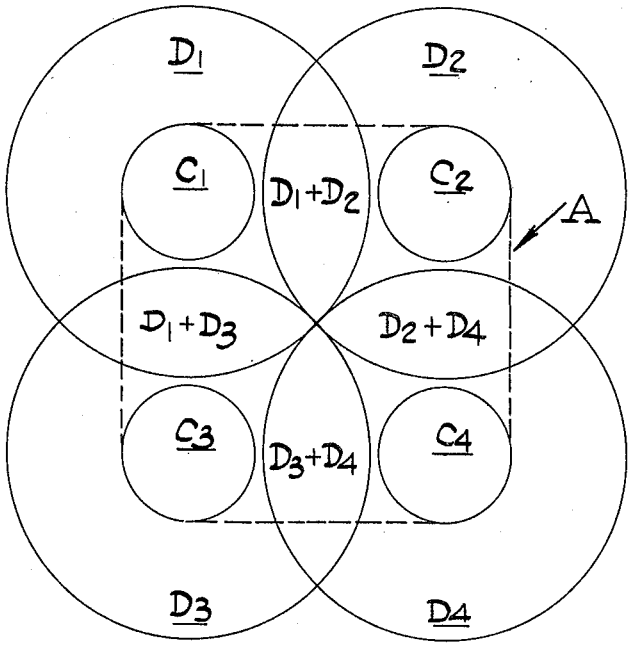

LUMINAIRE AND LUMINAIRE ARRANGEMENT FOR LIGHTING THE CEILING WITHIN A ROOM

BACKGROUND OF THE INVENTION

The present invention relates generally to indoor luminaires and more particularly to a luminaire and luminaire arrangement for indirectly lighting a room by directly lighting the ceiling within the room.

Today there is a tendency to design offices and schools with flexibility as one primary object. More specifically, many offices are being designed so that the desks, actually the furniture generally, and in some cases even the partitions, if any, are readily movable for rearranging the overall area. This is equally true of many schools, especially with respect to work tables and partitions. Accordingly, there is a special need for flexibility in lighting within areas of this type.

It has been found that down lighting, i.e., direct lighting in the downward direction, particularly by means of ceiling hung fixtures, does not fulfill this need for flexibility. Down lighting generally is usually predesigned in accordance with a predesigned arrangement of people and work stations, for example desks, within the given area being lighted. Once the particular fixtures are selected in accordance with this predesigned arrangement, it is difficult to rearrange the fixtures with a rearrangement of people and work stations within a room and maintain the lighting efficiency originally designed into the arrangement. It is, of course, even more difficult to do this where the lighting fixtures are fixed, for example in or to the ceiling as is typically done where down lighting is provided.

As will be seen hereinafter, the present invention overcomes many of these deficiencies by eliminating this concept of complete down lighting. More specifically, as will be seen, the present invention provides an arrangement for indirectly lighting a given area, for example an office or school, by directly lighting the ceiling within the area.

BRIEF SUMMARY OF THE INVENTION

One object of the present invention is to provide a luminaire for indirectly lighting a room area by directly lighting the ceiling within the area.

Another object of the present invention is to provide a luminaire of the last mentioned type wherein light passes from the luminaire to the ceiling directly above the luminaire, i.e., in the direction of zenith, but also passes from the luminaire to the ceiling at wide angles with zenith whereby areas on the ceiling laterally spaced substantial distances from the luminaire receive light therefrom.

Still another object of the present invention is to provide a luminaire of the last mentioned type which is not connected to the ceiling but readily movable within the area being lighted.

A further object of the present invention is to provide an overall arrangement for indirectly lighting a room using a plurality of luminaires of the above mentioned type.

Still a further object of the present invention is to provide an arrangement of the last mentioned type wherein the luminaires are positioned relative to one another such that light therefrom substantially uniformly illuminates areas of the ceiling directly above the luminaires and ceiling areas between the luminaires.

In accordance with one aspect of the present invention, a specific luminaire for indirectly lighting a room area by directly lighting the ceiling within the area is disclosed herein. This luminaire includes a housing which is located within the room below the ceiling and which includes an opening for the passage of light from within. This opening faces substantially vertically upward in the direction of zenith. Both a reflector and refractor are connected with the housing, the reflector being located within the housing and the refractor extending across and closing the opening. A light source, for example a high intensity discharge lamp, is also located within the housing. Some of the light from this source passes directly to and through the refractor and some of the light is reflected off the reflector and then passes through the refractor. In a preferred embodiment, the only light passing from within the housing passes through the opening in the housing, i.e., through the refractor. The refractor redirects at least a large portion of this light so that much of the light from the luminaire is at wide angles with zenith whereby to light areas on the ceiling laterally spaced from the housing. As will be seen these wide angle areas preferably receive a sufficient amount of light so that they are approximately one-half as bright in foot candles as those area directly above the luminaire.

In accordance with another feature of the present invention, an overall arrangement for indirectly lighting a room by directly lighting the ceiling within the room is disclosed herein. This arrangement includes a plurality of luminaires, preferably of the type just described, spaced from one another within the room below and spaced from the ceiling. These luminaires direct light substantially only onto the ceiling both directly above the luminaire in the direction of zenith and at wide angles with the zenith. The luminaires are preferably positioned relative to one another and relative to the ceiling such that the wide angle pattern of ceiling light from one luminaire overlaps with the wide angle pattern from an adjacent luminaire. In this way, the light on the ceiling directly over the luminaires and the ceiling light between the luminaires, i.e., the overlap, are uniform in brightness.

By providing a luminaire of the type just described in an overall arrangement for indirectly lighting a room by directly lighting the ceiling within the room, Applicants have provided lighting flexibility which is compatible with today's view of flexibility in offices and schools. By providing a uniformly bright ceiling area (directly over and between adjacent luminaires), Applicants have in effect made this area to act as a single, continuous luminaire of uniform brightness. Hence, the exact placement of work stations, partitions and so on is not as critical as it is in the case where predesigned down lighting is used. In addition, by making the source of this light, i.e., the luminaires, mobile, the lighting pattern can be readily modified to meet specific but possibly constantly changing needs.

BRIEF DESCRIPTION OF THE DRAWINGS

FIG. 1 is a schematic illustration, in elevation, of an arrangement for indirectly lighting a room in accordance with the present invention, specificaly illustrating a plurality of luminaires also constructed in accordance with the present invention.

FIG. 3 is a side elevational view of a portion of one of the luminaires of FIG. 1, partially broken away and particularly illustrating schematically the manner in which light is directed from the luminaire to the ceiling thereabove.

FIG. 4 is a graphic illustration of the ceiling light pattern resulting from the arrangement of FIG. 1, using four luminaires positioned at the four corners of a square.

DETAILED DESCRIPTION AND PREFERRED EMBODIMENTS

Figure 2:
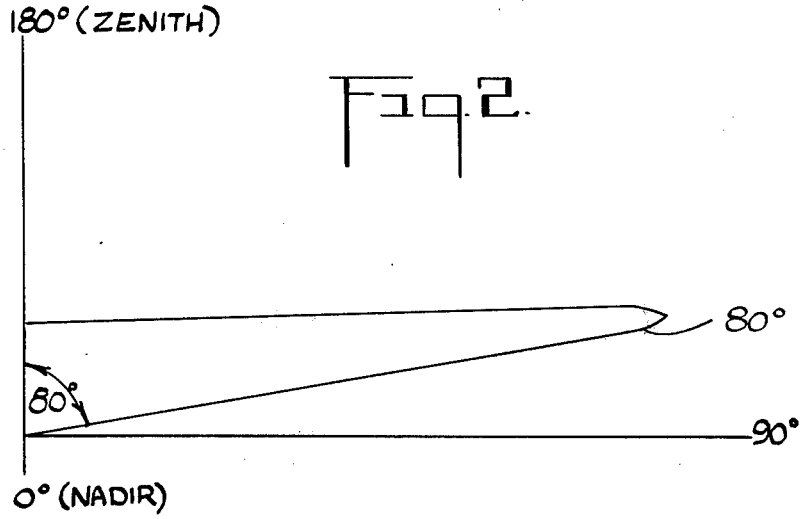
FIG. 2 is a graph illustrating an idealized lighting pattern resulting from a luminaire of FIG. 1.

Turning now to the drawings, wherein like components are designated by like reference numerals throughout the various figures, attention is specifically directed to FIG. 1 which illustrates an arrangement 10 for indirectly lighting a room 12 by directly lighting the ceiling 14 within the room. This arrangement comprises a plurality of luminaires 16 which are spaced from one another within room 12 and which rest on floor 18 of the room. As seen in FIG. 1, these luminaires are not connected to or with ceiling 14 and, in fact, are or may be made to be readily movable within the room.

Each luminaire 16 includes a top luminaire housing 20, preferably cylindrical in shape, located between ceiling 14 and floor 18, actually substantially closer to but spaced from the ceiling. The luminaire may also include a base 22, preferably a second housing, spaced directly below luminaire housing 20 and resting on or in close proximity to the floor 18 but preferably being maintained movable along the floor. Base 22 and a plurality of vertically extending support rods 24, also comprising part of luminaire 16, support luminaire housing 20 in the position just described. In this regard, as illustrated in FIG. 1, opposite ends of support rods 24 are suitably connected with luminaire housing 20 and base 22. Each luminaire 16 directs light from luminaire housing 20 towards ceiling 14 both in the direction of zenith, i.e., directly above the housing as indicated by dotted line 26, and at wide angles with zenith as indicated by dotted line 28 and angle $\theta$. For reasons to be explained below, adjacently positioned luminaires are preferably positioned such that there is a predetermined overlap in wide angle light on ceiling 14. Note in FIG. 1 that the dotted lines 28 intersect below the ceiling, thus indicating this overalap on the ceiling.

The exact numerical value of angle $\theta$ designed into luminaires 16 depends on the size of the luminaires, their positioning relative to one another and relative to ceiling 14. For example, in an actual working embodiment, luminaire 16 stands approximately 6½ feet high to the top of housing 20. This height has been chosen so that a person of normal height cannot see into the top of housing 20. If we assume the ceiling 14 is approximately 9 feet high, this leaves a spacing of approximately 2½ feet from the top of the housing 20 to ceiling 14 although this spacing may be between approximately 2 and 4 feet. With adjacent luminaires being spaced between approximately 15 and 25 feet apart, the general spacing desired, angle $\theta$ is approximately 80° to 85°. As will be seen, the light reaching the ceiling from one luminaire at angles between approximately 70° from zenith of that luminaire and 80° to 85° from zenith at least approximately overlaps with the same angular light of the adjacent luminaire. The importance of this will be explained below.

It is to be understood that this 80° to 85° value for angle $\theta$, the specific distances between luminaires and any other angular values referred to or to be referred to have or will be provided to illustrate an actual working embodiment but are not intended to limit the luminaire of the present invention. As stated previously, the exact numerical value for angle $\theta$ will depend upon how adjacent luminaires 16 are positioned relative to one another and relative to ceiling 14 and the size of these luminaires.

Where wide angle coverage on ceiling 14 is desired, as just discussed, and using the equation $E = (I/D^2)$ $\cos^3 \theta$ for uniform illumination, where $I$ is light intensity at any given point on the ceiling, $D$ is the distance from the luminaire to the given point and $\theta$ is the angle from zenith, it is found that most of the candle power from each luminaire 16 must be wide angle light from the luminaire, i.e., light directed within the previously mentioned overlap area, preferably closer to the dotted line 28, i.e., at distances further from the luminaire. FIG. 2 illustrates an illumination curve for illuminating ceiling 14 where the relative position of adjacent luminaires 16 and ceiling 14 are such that angle $\theta$ is approximately 80° and the luminaires are positioned as discussed above. As seen in FIG. 2, most of the illumination from luminaire 16 is located approximately 80° from zenith. Actually, if this calculation were run using 80° as the value for angle $\theta$, the theoretical curve required for uniform illumination would be much sharper, much more pointed and spear light, than that shown in FIG. 2. However, it has been found by experience that the less sharp curve illustrated in FIG. 2 is as close to the theoretical curve as can be practically achieved.

The necessity for the type of light pattern illustrated by the curve in FIG. 2 is best illustrated in FIG. 3. In this latter figure, luminaire housing 20 is shown in position under ceiling 14. As will be seen hereinafter, the entire top of housing 20 is open to the passage of light so that light from within the housing can be directed towards the ceiling. As will also be seen, luminaire 16 includes a light source 30 located at the bottom of housing 20, the light source being located along zenith. Luminaire 16 includes a reflector 32 and refractor 34, also to be described hereinafter. As can be seen in FIG. 3, light directly from source 30, i.e., light not reflected by reflector 32, passes through the opening in housing 20 at an angle B with zenith to provide an overhead light pattern *c* on ceiling 14 (only a portion of the pattern to one side of zenith is illustrated). Like angle $\theta$, the value of angle B depends on several factors including the spacing between ceiling 14 and housing 20, the width of the opening in housing 20, the depth of the housing and the physical size of the light source. With the luminaires positioned in the manner discussed previously and with housing 20 being 24 inches wide and 18 inches deep, angle B is approximately 50° from zenith. As previously stated, luminaire 16 must also direct light to the ceiling at wide angles with zenith, i.e., at distances substantially laterally of the luminaire. This addition to the overall light pattern on the ceiling 14 is indicated at *d* and may be referred to as a wide angle pattern.

Extending both overhead pattern *c* and wide angle pattern *d* circumferentially around the axis represented by zenith and using the above recited equation for uniform illumination with angle B being, for example 50° and angle $\theta$ being, for example, 80°, it can be easily seen that to provide uniform lighting across both patterns most of the candle powder from the luminaire must go out at remote angles to zenith, i.e., to areas on the ceiling designated by the pattern *d*. To obtain this substantially uniform illumination across both light patterns, it becomes more important to provide most of the illumination in pattern *d* as the angle $\theta$ becomes greater and as the distance between the ceiling and the top of housing 20 becomes less, i.e., as the light source is positioned closer to the ceiling. While it would be highly desirable to provide a single luminaire which includes an optical arrangement, i.e., a reflector 32 and particularly a refractor 34 cooperating with a light source 30 to provide this uniform illumination across the two patterns *c* and *d* this is quite difficult to attain in an actual working embodiment without requiring that angle $\theta$ be small and hence a large number of closely spaced luminaires.

The optical arrangement of the present invention is specifically designed to provide large spacings between adjacent luminaires, for example between 15 and 25 feet and specifically to direct most of the candle power from the luminaire into pattern *d* so that the brightness in this wide angle pattern is preferably approximately one-half of the brightness in the overhead pattern, i.e., pattern *c*. Hence, two luminaires 16 can be placed adjacent one another such that their respetive adjacent wide angle patterns (on ceiling 14) just overlap, as seen in FIG. 1. In this way, the overlapping area is equally as bright as overhead areas C resulting in that portion of the ceiling extending from zenith of one of the luminaires to zenith of the other being approximately uniform in brightness. By positioning a larger number of luminaires, for example four luminaires in this way, i.e., at the four corners of a square such that the wide angle areas *d* of adjacent luminaires overlap as seen in FIG. 4, the entire ceiling area between these luminaires, i.e., between their respective zenith axes, is of uniform brightness. Note in FIG. 4, that the overhead areas $C_1$ to $C_4$ combine with overlapping wide angle areas $D_1$ and $D_2$, $D_2$ and $D_4$, $D_3$ and $D_4$ and $D_1$ and $D_3$ to provide a substantially uniformly bright overall area A. In this regard, this area A will be uniformly bright only if the color of the ceiling within this area is uniform so as to reflect uniformly. The ceiling is preferably diffusely reflective, preferably white or, in any case, a light color so as not to reduce lighting efficiency. In this way, area A, in effect, acts as a single, continuous luminaire of uniform brightness.

The particular pattern illustrated in FIG. 4 is preferred where each of the areas $D_1$, $D_2$, $D_3$ and $D_4$ is approximately one-half as bright as each of the areas $C_1$, $C_2$, $C_3$ and $C_4$. If this is not exactly the case, the luminaires should be positioned such that the ceiling area directly above and between the luminaires is as uniformly bright as possible. For example, if the outlying areas of patterns $D_1$, $D_2$ and so on are not as bright as the areas in these patterns close in, the luminaires could be positioned so that all four patterns $D_1$, $D_2$, $D_3$ and $D_4$ overlap at the center of area A. In any event, it is preferred that the luminaires be positioned so that the light directed to the ceiling therefrom is as uniformly bright as possible. With the luminaires of the present invention, this can be achieved, at least as viewed by the naked eye if not precisely achieved in accordance with meter indicating data.

Figure 5:
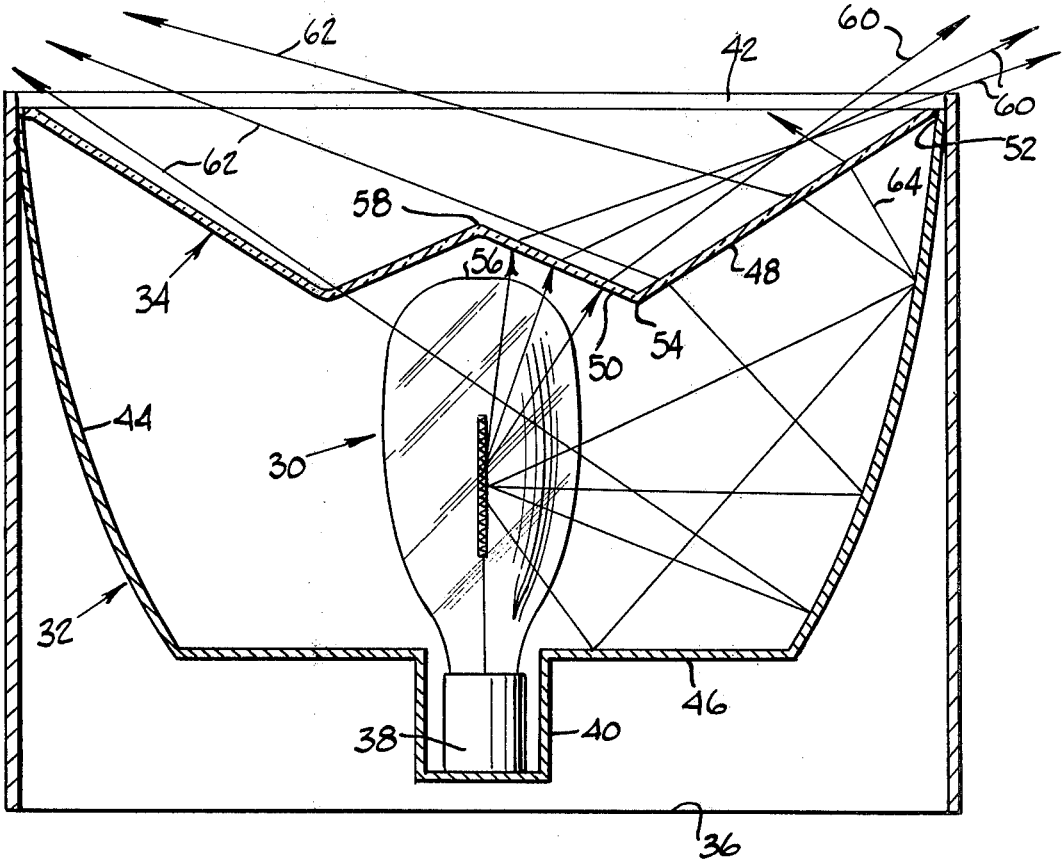
FIG. 5 is a cross-sectional view of a portion of the luminaire of FIG. 2.
Figure 6:
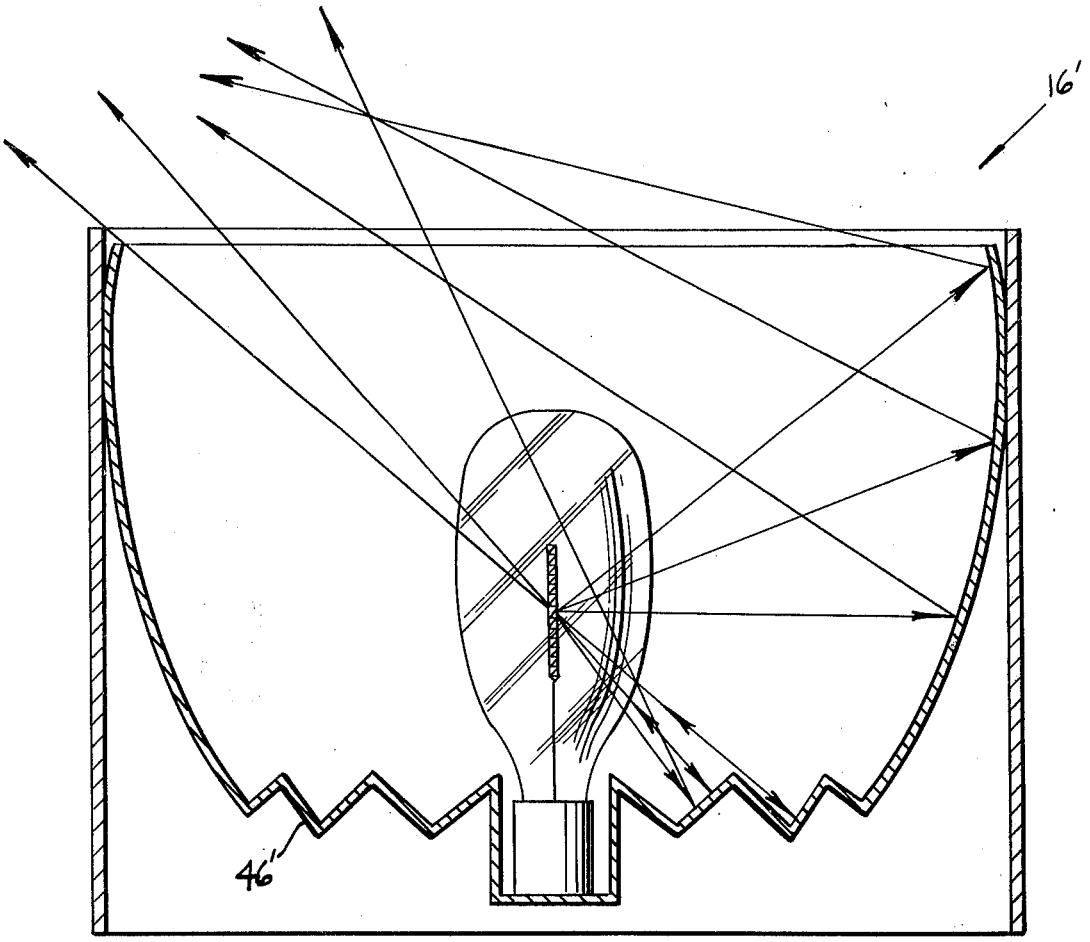
FIG. 6 is a view similar to that of FIG. 5 but depicting a modified luminaire.

Turning specifically to FIG. 5, attention is directed to the optical arrangement which comprises part of overall luminaire 16 and which is responsible for providing on ceiling 14 both pattern C directly above the luminaire and pattern D at wide angles with zenith. As stated previously, this optical arrangement includes a light source 30. The light source is not limited to any particular type but is preferably a high intensity discharge (HID) lamp, for example a metal halide lamp. As seen in FIG. 5, light source 30 extends in the direction of and along zenith, indicated at 26, and is positioned within housing 20 towards the bottom 36 of the housing. While the light source may be mounted in this position in any suitable manner using conventional means (not shown), in a preferred embodiment the base 38 of the light source is disposed within a pocket 40 comprising part of reflector 32 which will be described hereinafter. Suitable means (not shown) are provided to fix the light source within pocket 40.

As also stated previously, housing 20 includes an entirely open top side, which opening is designated at 42. Reflector 32 which, as stated, also comprises part of the overall optical arrangement of luminaire 16 is located within housing 20. This reflector which is constructed of a suitable material having a specular reflecting surface at least on the side facing light source 30 includes one section 44 which circumscribes the light source within housing 20. Section 44, which is substantially parabolic in longitudinal section as illustrated in FIG. 5, extends downwardly towards the bottom 36 of housing 20 from the outer periphery of opening 42. The bottom end of section 44 merges with a second flat reflector section 46 which lies in a plane substantially normal to the light source 30, i.e., normal to zenith and which also circumscribes the light source. Reflector section 46 joins section 44 at its outermost periphery to previously mentioned pocket 40 at its innermost periphery.

Refractor 34 which is constructed of any suitable material, for example, glass or plastic, is connected by suitable means (not shown) with housing 20 and extends entirely across opening 42 so as to close the opening. In this regard, the refractor acts as a cover to prevent dust or other outside elements from entering within the housing. The refractor is comprised of two segments which are preferably integral with one another, an outer circumferential segment 48 and a central segment 50.

Outer circumferential segment 48 has its outer periphery 52 adjoining the outer periphery of opening 42 and extends into housing 20 in a relatively flat fashion at an acute angle with the vertical, i.e., with zenith. The inner periphery 54 of section 48 circumscribes light source 30, preferably in a horizontal plane just below the topmost edge 56 of the light source. The reason for this preferred positioning of segment 48 will be discussed hereinafter. Central segment 50, as illustrated in FIG. 4, joins the inner periphery 54 of the segment 48 and is positioned between light source 30 and opening 42 of housing 20. This central segment is in the shape of an inverted cone having its apex 58 located just above the topmost edge 56 of the light source.

In addition to the optical arrangement just described, luminaire 16 includes conventional means for energizing light source 30. Where the light source is for example a high intensity discharge lamp, such means would include a conventional ballast and associated circuitry. In a preferred embodiment of the present invention, this ballast and/or possibly other conventional equipment making up luminaire 16 is physically located within the bottom housing 22 of the luminaire. This lower housing not only provides a convenient and pleasant appearing means for "hiding" the ballast and/or other means associated with the luminaire but the additional weight of these means also provides bottom weight to the overall luminaire so as to keep the luminaire more reliably in position on floor 18, as shown in FIG. 1.

Having described the construction of one of the luminaires 16, attention is now directed to the manner in which this luminaire operates optically to provide the aforedescribed pattern of light on ceiling 14. As seen in FIG. 5, a portion of light from source 30 passes directly to and through refractor 34 without being reflected by reflector 32. Vector rays 60 indicate a portion of this light. In addition, some of the light from source 30 is first relected and thereafter passes to and through the refractor. A portion of this light is initially and only reflected by segment 44 of the reflector as indicated for example by vector rays 62 and some of this light is first reflected by central segment 46, thereafter by segment 44 and from segment 44 passes to and through the refractor, as indicated for example by vector rays 64. Note in all the cases indicated in FIG. 4 and, in fact, in most cases, the light passing through refractor 34, either through circumferential segment 48 or central segment 50, is refracted, i.e., bent further from zenith than the light impinging on the internal surface of the refractor.

The particular amount of refraction and the particular direction the light rays take after being refracted depends upon the location of the light relative to any given point on the refractor and the angle at which the light impinges on the refractor. In any event, it has been found that by refracting much of the direct light and reflected light from source 30 at wide angles with zenith, most of the foot candles from source 30 can be directed towards pattern *d* (see FIG. 3) on ceiling 14, i.e., at the wide angle pattern of light on the ceiling. The exact amount of foot candles to be directed into area d as compared to area *c*, depends upon many factors such as, for example, the intensity of light source 30, the size of housing 20, the size of opening 42, the distance between the housing and ceiling and the desired angle $\theta$. In view of the teachings of the present invention, one could readily determine the particular design requirements for reflector 32 and refractor 34 to provide aforedescribed overhead and wide angle patterns *c* and *d* such that the wide angle pattern is half as bright as the overhead pattern. In this regard, the particular design of refractor 34 as illustrated, while not being intended to limit the present invention, does meet this requirement and also has the advantage of minimizing the amount of light which just grazes its surface from the reflector. In other words, most of the reflected light impinging on retractor 34 does so at an angle outside the "grazing angle." This is desirable since much of the light from the grazing rays is lost in the refractor and hence reduces the overall efficiency of the luminaire.

In some cases it may be found that a large portion of the light from source 30 which is initially reflected off of central segment 46 of reflector 32 or at least more than is desirable eventually passes through the refractor at small angles from zenith, i.e., into pattern *c*. In order to minimize, reduce or even eliminate this light segment 46 can be made non-reflective, for example by coating the surface with a non-reflective substance. However, this, of course, reduces the overall efficiency of the luminaire. Another way to accomplish this without substantially reducing luminaire efficiency is illustrated in FIG. 5. This figure shows the top portion, i.e., the housing and optical arrangement of a luminaire identical to luminaire 16, with one exception. The luminaire illustrated in FIG. 5 is designated by the reference numeral 16' and includes a central reflector segment 46' which unlike previously described segment 46 is scalloped in a way which reflects light from source 30 back towards the refractor 34 so as to ultimately reach ceiling 14 at wider angles with zenith, preferably into pattern *d*. The exact design of these scallops will of course depend upon the overall optical design and in accordance with the teachings of the present invention could be readily provided by one with ordinary skill in the art.

Luminaires 16, as illustrated, are of the type which rest directly on floor 18 within room 12 for indirectly lighting the room by directly lighting ceiling 14. While this type of arrangement is preferred in order to achieve both flexibility and luminaire mobility, it is to be understood that the luminaires could be secured directly to the ceiling. While this does reduce the mobility of the luminaires with respect to contemplatd changes in lighting need within the room, it nevertheless would provide indirect lighting of the room by direct lighting of the ceiling and is contemplated as a secondary embodiment of the present invention. Of course, the optical arrangements making up these ceiling hung luminaires would be identical or substantially identical to that described heretofore. Suitable means for hanging the luminaires to the ceiling could readily be provided.

What we claim is:

1. A luminaire for indirectly lighting a room by directly lighting the ceiling within said room, said luminaire comprising:

a. a housing located within said room below said ceiling and including an opening for the passage of light from within said housing, said opening facing substantially vertically upward in the direction of zenith;

b. means supporting said housing such that said opening faces the direction of zenith;

c. reflector means connected with and positioned within said housing;

d. refractor means connected with said housing and extending across and closing said opening;

e. a light source connected with and located within said housing, some of the light from said source passing directly to and through said refractor means extending across said opening and some of said light being reflected off of said reflector means and thereafter passing to and through said refractor means to said ceiling; and f. said refractor means redirecting said light such that a portion thereof passes therethrough in the direction of zenith and a portion at wide angles with zenith whereby to light areas on said ceiling directly above said housing and laterally spaced from said housing, said refractor means including i. an outer circumferential segment including the outer periphery of said refractor means and an inner circumferential periphery in said housing and spaced from said light source, said outer circumferential segment extending inwardly from its outer periphery to its inner periphery at an acute angle with zenith, and ii. a central segment joining the inner periphery of said outer segment and positioned between said light source and opening, said central segment being in the shape of an inverted cone having its apex located above the uppermost edge of said light source.

2. A luminaire according to claim 1 wherein said portion of light redirected by said refractor means includes light redirected at angles up to approximately 80° with zenith.

3. A luminaire according to claim 1 wherein said light source is a high intensity discharge source.

4. A luminaire according to claim 1 wherein said refractor means includes an outer circumferential periphery adjacent the outer circumferential periphery of said opening, said refractor means extending from its outer periphery inwardly into said housing.

5. A luminaire according to claim 1 wherein said reflector means includes:

a. a scalloped bottom surface facing said opening within said housing and located below and circumscribing said light source; and b. a circumferential side surface extending upwardly to the outer periphery of said opening from the outer periphery of said scalloped bottom surface.

6. A luminaire according to claim 1 wherein said supporting means supports said housing such that said housing is not connected with said ceiling.

7. A luminaire according to claim 1 wherein said supporting means includes:

a. a base located directly below and spaced from said housing, said base being adapted to rest adjacent the floor of said room; and b. at least one support post connecting said housing with said base.

8. A luminaire according to claim 7 wherein said base is a second housing.

9. A luminaire according to claim 8 including ballast means connected with said light source, said ballast means being located in said second housing.

10. A luminaire according to claim 1 wherein said housing is such that the only light passing out of said housing is through said opening.

11. A luminaire for indirectly lighting a room by directly lighting the ceiling with said room, said luminaire comprising:

a. a housing located within said room below said ceiling and including an opening having a circumferential outer periphery for the passage of light through said opening from within said housing, said opening facing substantially upward in the direction of zenith;

b. means supporting said housing such that said opening faces the direction of zenith;

c. a longitudinally extending high intensity discharge lamp connected with and located within said housing, said lamp extending vertically along zenith;

d. a reflector connected with and located within said housing, said reflector including a light reflective surface spaced from and circumscribing said lamp, said light reflective surface extending downwardly towards the bottom of said housing from the outer periphery of said opening;

e. a refractor connected with said housing and extending across said opening to close said opening, said refractor including i. an outer circumferential segment having an outer periphery adjoining the outer periphery of said opening and an inner periphery in said housing and circumscribing said lamp in a horizontal plane below the topmost edge of said lamp, said outer segment extending inwardly from its outer periphery to its inner periphery at an acute angle with zenith, and ii. a central segment joining the inner periphery of said outer segment and positioned between said lamp and opening, said central segment being in the shape of an inverted cone having its apex located above the topmost edge of said lamp;

f. some of the light from said lamp passing directly to and through said refractor and some of said light being reflected off of said reflective surface and thereafter passing to and through said refractor; and g. said refractor redirecting said light such that a portion thereof passes therethrough in the direction of zenith and a portion at wide angles with zenith whereby to light areas on said ceiling directly above said housing and laterally spaced from said ceiling.

12. A luminaire according to claim 11 wherein said supporting means supports said housing such that said housing is not connected in any way with said ceiling.

13. A luminaire according to claim 12 wherein said supporting means includes a base located directly below and spaced from said housing, said base being adapted to rest on the floor of said room, and at least one post connecting said housing with said base.

14. A luminaire according to claim 13 wherein said base is a second housing and including ballast means, said ballast means being located within said housing.

15. A luminaire for indirectly lighting a room by directly lighting the ceiling within said room said luminaire comprising:

a. a housing located within said room below said ceiling and including an opening for the passage of light from within said housing, said opening facing substantially vertically upward in the direction of zenith:

b. means supporting said housing such that said opening faces the direction of zenith;

c. reflector means connected with and positioned within said housing;

d. refractor means connected with said housing and extending across and closing said opening;

e. a light source connected with and located within said housing, some of the light from said source passing directly to and through said refractor means extending across said opening and some of said light being reflected off of said reflector means and thereafter passing to and through said refractor means to said ceiling; and f. said refractor means being such that most of the light passing therethrough is refracted further from zenith than the direction of the light impinging on the internal surface of the refractor from said light source.

16. A luminaire for indirectly lighting a room by directly lighting the ceiling with said room, said luminaire comprising:

a. a housing located within said room below said ceiling and including an opening for the passage of light from within said housing, said opening facing substantially vertically upward in the direction of zenith;

b. means supporting said housing such that said opening faces the direction of zenith;

c. reflector means connected with and positioned within said housing;

d. refractor means connected with said housing and extending across and closing said opening, said refractor means including a central segment and an outer circumferential segment extending out from said central segment at a different angle than said central segment;

e. a light source connected with and located within said housing, some of the light from said source passing directly to and through said refractor means extending across said opening and some of said light being reflected off of said reflector means and thereafter passing to and through said refractor means to said ceiling, most of direct light passing through said central segment and most of said reflected light passing through said outer segment.

* * * * *